US011809102B2

(12) United States Patent
Katano et al.

(10) Patent No.: US 11,809,102 B2
(45) Date of Patent: Nov. 7, 2023

(54) RECORDING MATERIAL COOLING DEVICE, IMAGE FORMING APPARATUS, AND IMAGE FORMING SYSTEM

(71) Applicant: CANON KABUSHIKI KAISHA, Tokyo (JP)

(72) Inventors: Shingo Katano, Ibaraki (JP); Kenichi Tanaka, Ibaraki (JP); Keita Kondo, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/715,517

(22) Filed: Apr. 7, 2022

(65) Prior Publication Data

US 2022/0229385 A1 Jul. 21, 2022

Related U.S. Application Data

(62) Division of application No. 17/326,199, filed on May 20, 2021, now Pat. No. 11,327,421.

(30) Foreign Application Priority Data

Jun. 9, 2020 (JP) ..... 2020-100038

(51) Int. Cl.
*G03G 15/20* (2006.01)
*G03G 15/00* (2006.01)

(52) U.S. Cl.
CPC ..... *G03G 15/2017* (2013.01); *G03G 15/2021* (2013.01); *G03G 15/6573* (2013.01)

(58) Field of Classification Search
CPC ..... G03G 15/2017; G03G 15/2021; G03G 15/6573; G03G 2215/00421; B65G 2207/10
USPC ..... 399/341, 405
See application file for complete search history.

(56) References Cited

U.S. PATENT DOCUMENTS

| | | | | |
|---|---|---|---|---|
| 8,655,242 | B2 | 2/2014 | Tanaka | 399/323 |
| 8,942,612 | B2 | 1/2015 | Tanaka | 399/330 |
| 8,958,716 | B2 | 2/2015 | Saito | 399/92 |
| 9,069,299 | B2 | 6/2015 | Tanaka | G03G 15/2028 |
| 9,354,562 | B2 | 5/2016 | Tanaka | G03G 15/2028 |
| 9,389,554 | B2 | 7/2016 | Tanaka et al. | G03G 15/2021 |
| 9,465,336 | B2 | 10/2016 | Saito et al. | G03G 15/2053 |
| 9,547,262 | B2 | 1/2017 | Hirayama et al. | G03G 15/2039 |
| 9,563,163 | B2 | 2/2017 | Tanaka et al. | G03G 15/502 |
| 10,061,242 | B2 | 8/2018 | Tanaka | G03G 15/2032 |
| 10,564,576 | B2 | 2/2020 | Tanaka et al. | G03G 15/2053 |
| 10,649,374 | B2 | 5/2020 | Mori et al. | G03G 15/1685 |
| 10,719,042 | B2 | 7/2020 | Hirayama et al. | G03G 15/2039 |

(Continued)

FOREIGN PATENT DOCUMENTS

| | | | |
|---|---|---|---|
| JP | 05-142959 A | * | 6/1993 |
| JP | 2009-181055 | | 8/2009 |

*Primary Examiner* — Robert B Beatty
(74) *Attorney, Agent, or Firm* — Venable LLP

(57) ABSTRACT

A recording material cooling device includes a first unit provided with a first endless belt and a cooling member, a second unit provided with a second endless belt and a supporting member but not provided with a cooling member, a holding member and a fixing member. The holding member is fixed to a supporting frame and rotatably holds the supporting member in order to be rotated by a user. The fixing member fixes the supporting member to the holding member at any rotating position by the user.

5 Claims, 10 Drawing Sheets

(56) References Cited

U.S. PATENT DOCUMENTS

| | | | | |
|---|---|---|---|---|
| 2013/0279956 | A1* | 10/2013 | Aoki | G03G 15/2017 399/329 |
| 2014/0369712 | A1* | 12/2014 | Kuroda | G03G 15/6573 399/110 |
| 2015/0277312 | A1* | 10/2015 | Chikugo | G03G 15/6573 399/329 |
| 2017/0192387 | A1 | 7/2017 | Tanaka | G03G 15/2039 |
| 2021/0240113 | A1 | 8/2021 | Tanaka et al. | G03G 15/2025 |
| 2021/0240114 | A1 | 8/2021 | Tanaka et al. | G03G 15/6573 |
| 2021/0373465 | A1 | 12/2021 | Kondo et al. | G03G 21/206 |

* cited by examiner

RECORDING MATERIAL COOLING DEVICE, IMAGE FORMING APPARATUS, AND IMAGE FORMING SYSTEM

This application is a division of application Ser. No. 17/326,199 filed May 20, 2021, currently pending, and claims priority under 35 U.S.C. § 119 from Japan application No. 2020-100038 filed in Japan on June 9, 2020; the content of all of which are incorporated herein by reference as if set forth in full.

FIELD OF THE INVENTION AND RELATED ART

The present invention relates to a recording material cooling device that cools recording material via a belt, and to an image forming apparatus and image forming system equipped with such device.

In the image forming apparatus, a toner image formed on the recording material is fixed on the recording material by heating and pressurising it in a fixing device. As a result, a temperature of the recording material being conveyed from the fixing device is higher than that before fixing. If the recording material after the toner image has been fixed is discharged and stacked in a discharge tray at a high temperature, toner may stick to the other recording materials stacked on the tray. To prevent such sticking of the recording material, a recording material cooling device is provided to lower the temperature of the recording material after the toner image is fixed. (Japanese Laid-Open Patent Application No. 2009-181055). The recording material cooling device described in Japanese Laid-Open Patent Application No. 2009-181055 is a belt-cooling device, in which a heat sink cools one of a pair of belts that nip and feed the recording material that has passed through the fixing device, and the temperature of the recording material is lowered through the cooled belt. Such recording material cooling device is attached to the image forming apparatus by means of a pair of support plates that rotatably support a plurality of rollers that stretch the belt at both ends and are fixed to a main assembly frame, for example.

In the above-mentioned belt-cooled recording material cooling device, if one of the multiple rollers stretching the belt is not parallel to the other rollers but tilted relative to them, the rotating belt may move in a width direction crossing a recording material feeding direction (so-called belt shift). In such a case, the belt may shift too close to the support plate supporting each roller, and a belt edge may contact the support plate, which may damage the belt and the support plate. To solve this issue, steering control is used to suppress the belt shifting by tilting one of the multiple rollers that tension the belt (called a steering roller) according to a position of a belt edge portion.

The relative inclination of the rollers that causes the belt shifting described above can be caused by the parts tolerance of each element that constitutes a belt unit, such as, the plurality of rollers that stretch the belt and the pair of support plates that support each roller. Therefore, in the past, the relative inclination of the rollers that may be caused by component tolerances in the belt unit has been taken into account so that steering control can be performed as described above.

However, in the past, even though steering control was applied, the belt would lean over and the belt and support plate would be damaged. This is because the support plate is displaced during installation due to component tolerances in the parts that affect installation in the recording material cooling device, and the relative inclination of the rollers can be so great that it is difficult to control the belt shifting even with steering control.

In view of the above problem, the present invention aims to provide a recording material cooling device capable of correcting the relative inclination of rollers that may occur when the recording material cooling device is mounted on a support frame, and an image forming apparatus and image forming system equipped with such recording material cooling device.

SUMMARY OF THE INVENTION

According to an aspect of the present invention, there is provided a recording material cooing device configured to cool a recording material on which a toner image is fixed by heating, said recording material cooling device comprising: a supporting frame; a first unit provided with a first endless belt, a first plurality of rollers stretching said first belt, and a cooling member contacting an inner peripheral surface of said first belt and configured to cool said first belt; a second unit provided with a second endless belt contacting an outer peripheral surface of said first belt and configured to form a nip portion nipping and feeding the recording material, a second plurality of rollers stretching said second belt, a first supporting member and a second supporting member disposed in a widthwise direction crossing a feeding direction of the recording material and configured to support both end portions of said second plurality of rollers; a holding member fixed to said supporting frame and configured to rotatably hold said first supporting member; and a fixing member configured to fix said first supporting member to said holding member at any rotating position of said first supporting member.

Further features of the present invention will become apparent from the following description of exemplary embodiments (with reference to the attached drawings).

DESCRIPTION OF THE EMBODIMENTS

<Image Forming Apparatus>

Figure 1:
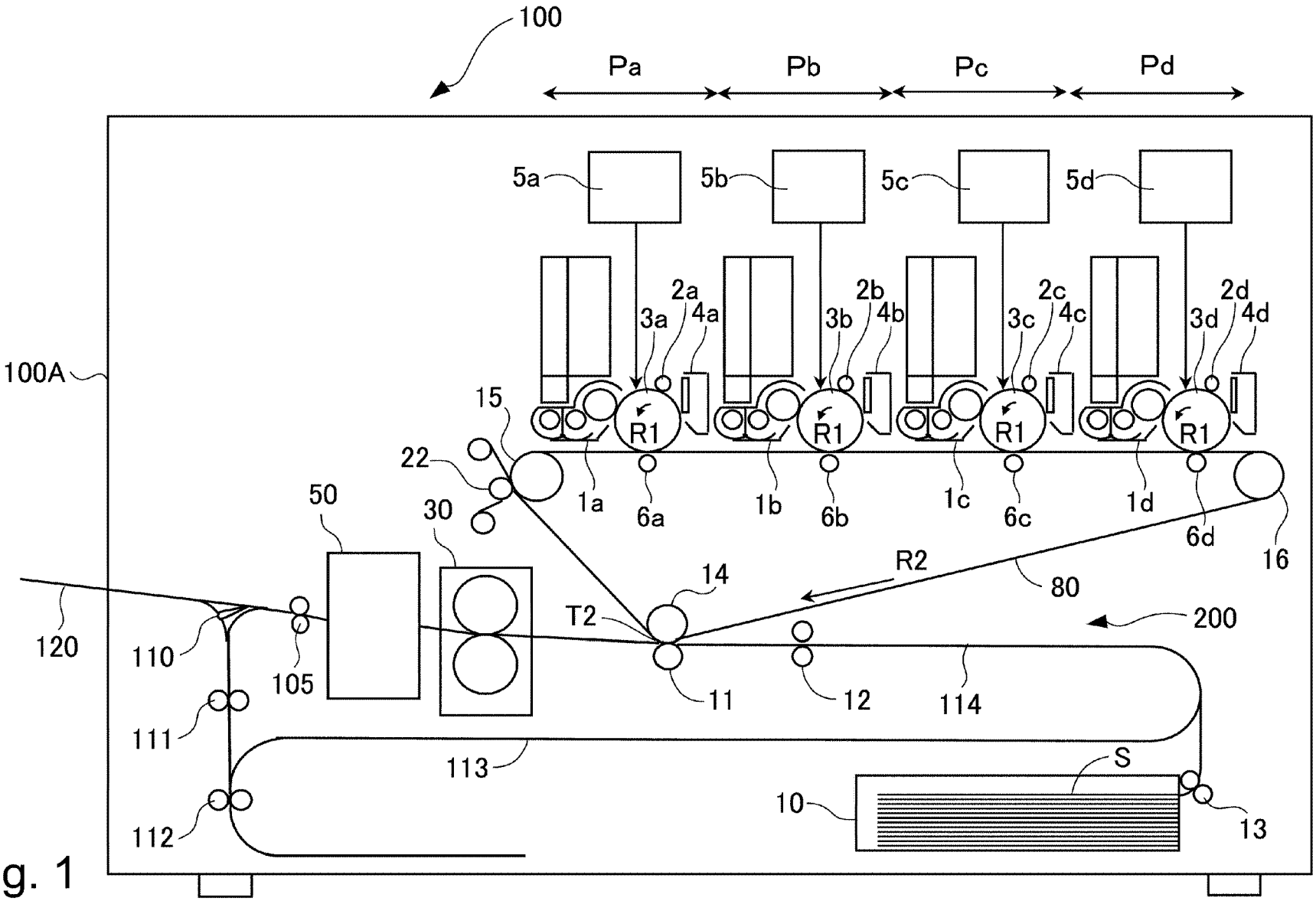
FIG. 1 is a schematic view showing the configuration of an image forming apparatus.

A recording material cooling device of this embodiment will be described below. An image forming apparatus 100 shown in FIG. 1 is an electrophotographic tandem type full colour printer which has image forming portions Pa, Pb, Pc, Pd which form yellow, magenta, cyan, and black images, respectively. The image forming apparatus 100 forms a toner image on a recording material S in response to image information from a document reader (not shown) or an external device such as a personal computer (not shown) that is communicatively connected to the image forming apparatus 100. The recording material S can be various types of sheet materials such as plain paper, thick paper, rough paper, uneven paper, coated paper, plastic film, cloth, etc. In the case of this embodiment, the image forming portion Pa to Pd, primary transfer rollers 6*a* to 6*d*, intermediate transfer belt 80, secondary transfer inner roller 14, secondary transfer outer roller 11, and tensioning rollers 15 and 16 constitute an image forming unit 200 that forms a toner image on the recording material S.

A conveying process of the recording material S of the image forming apparatus 100 will be described. The recording material S is stored in a paper cassette 10 and is fed from the cassette 10 by a paper feed roller 13 in accordance with the image forming timing. The recording material S fed by the paper feed roller 13 is conveyed to a registration roller 12 located in the middle of a conveyance path 114. After skew correction and timing correction of the recording material S is performed by the registration roller 12, the recording material S is sent to the secondary transfer portion T2. The secondary transfer portion T2 is a transfer nip portion formed by the secondary transfer inner roller 14 and the secondary transfer outer roller 11, and the toner image is transferred onto the recording material S as a secondary transfer voltage is applied to the secondary transfer outer roller 11.

In contrast to the process of conveying the recording material S up to the secondary transfer portion T2 described above, the process of forming an image that is sent up to the secondary transfer portion T2 at the same timing is described below. First, the image forming portions Pa, Pb, Pc, and Pd are described. The image forming portions Pa, Pb, Pc, and Pd of each colour are constructed in almost the same way, except that the toner colours used in developing units 1*a*, 1*b*, 1*c*, and 1*d* are different: yellow, magenta, cyan, and black. Therefore, in the following, the image forming portion Pd of black will be explained as a representative, and other image forming portions Pa, Pb, and Pc will be omitted.

The image forming portion Pd mainly consists of the developing unit 1*d*, a charger 2*d*, a photosensitive drum 3*d*, a photosensitive drum cleaner 4*d*, and an exposure device 5*d*. The surface of the photosensitive drum 3*d*, which is rotated in a direction of arrow R1, is uniformly charged in advance by the charger 2*d*, and then an electrostatic latent image is formed by the exposure device 5*d*, which is driven based on an image information signal. Next, the electrostatic latent image formed on the photosensitive drum 3*d* is developed into a toner image by the developing unit 1*d* using a developer agent. Then, the toner image formed on the photosensitive drum 3*d* is primary transferred onto the intermediate transfer belt 80 in response to the application of a primary transfer voltage to the primary transfer roller 6*d*, which is positioned between the image forming portion Pd and the intermediate transfer belt 80. The toner remaining from the primary transfer, which remains slightly on the photosensitive drum 3*d*, is collected by the photosensitive drum cleaner 4*d*. As previously mention, image forming portions Pa, Pb and Pc are arranged similarly to image forming portion Pd, and include respective ones of chargers 2*a*/2*b*/2*c*, photosensitive drums 3*a*/3*b*/3*c*, photosensitive drum cleaners 4*a*/4*b*/4*c*, and exposure devices 5*a*/5*b*/5*c*.

The intermediate transfer belt 80 is stretched by the secondary transfer inner roller 14 and the tensioning rollers 15 and 16, and is driven in a direction of an arrow R2. In the case of this embodiment, the tensioning roller 16 also serves as the drive roller that drives the intermediate transfer belt 80. The image forming process of each colour, which is processed in parallel by image forming portion Pa to Pd, is performed by sequentially overlapping the toner image of the upstream colour that has been primary transferred onto the intermediate transfer belt 80. As a result, a full-colour toner image is finally formed on the intermediate transfer belt 80 and is conveyed to the secondary transfer portion T2. A residual toner from the secondary transfer after passing through the secondary transfer portion T2 is removed from the intermediate transfer belt 80 by a belt cleaner 22.

With the conveying process and image formation process described above, the timing of the recording material S and the full-colour toner image matches at the secondary transfer portion T2, and secondary transfer is performed. After that, the recording material S is fed to a fixing device 30, where the toner image is fixed on the recording material S by applying a predetermined amount of pressure and heat. The fixing device 30 nips and feeds the recording material S on which the toner image has been formed, and heats and pressurises the conveyed recording material S to fix the toner image on the recording material S. In other words, the toner of the toner image formed on the recording material S is melted and mixed by heat and pressure, and is fixed to the recording material S as a full-colour image. In this way, the series of image formation process is completed. In the case of this embodiment, the recording material S on which the toner image has been fixed is conveyed from the fixing device 30 to a recording material cooling device 50 for cooling. For example, the temperature of the recording material S is about 90° C. immediately before the recording material cooling device 50, but it is lowered to about 60° C. after passing through the recording material cooling device 50.

In the case of single-sided image formation, the recording material S cooled by the recording material cooling device 50 is conveyed between a pair of discharge rollers 105 and discharged directly onto a discharge tray 120. On the other hand, in the case of double-sided image formation, a feeding path is switched from a path leading to the discharge tray 120 to a double-sided conveying device 111 by means of a switching member 110 (called a flapper, etc.), and the recording material S held and fed by the discharge rollers 105 is sent to the double-sided conveying device 111. After that, a reversing roller 112 switches the front and back ends of the recording material S, and the recording material S is sent to the conveyance path 114 again via a duplex path 113.

The subsequent conveyance and the image formation process for the reverse side (second side) are the same as described above, so the explanation is omitted.

<Recording Material Cooling Device>

Figure 2:
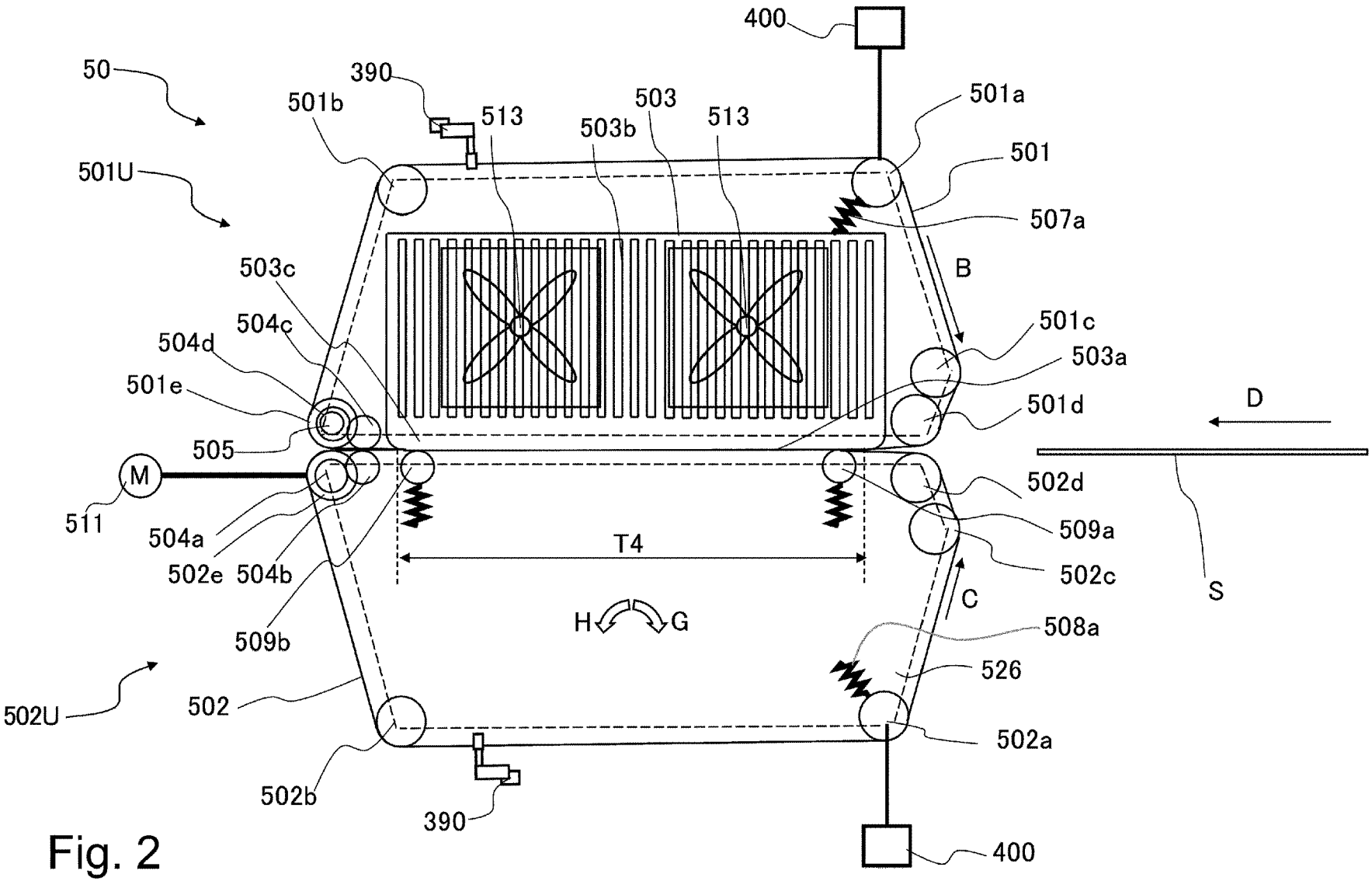
FIG. 2 is a schematic view showing a recording material cooling device of an embodiment.

Next, the recording material cooling device 50 of this embodiment will be explained using FIGS. 2 to 9(*c*). The recording material cooling device 50 of this embodiment is a belt cooling type recording material cooling device. As shown in FIG. 2, the recording material cooling device 50 has a first unit 501U and a second unit 502U. The first unit 501U has an endless first belt 501, first belt tensioning rollers (501*a* to 501*e*) as first rollers, a heat sink 503, a sensor portion 390, etc. On the other hand, the second unit 502U has an endless second belt 502, second belt tensioning rollers (502*a* to 502*e*) as second rollers, pressure rollers (509*a*, 509*b*), sensor portion 390, etc.

Both the first belt 501 and the second belt 502 are film-like endless belts formed using, for example, a strong polyamide resin. The second belt 502 is hung on a plurality of second belt tensioning rollers 502*a* to 502*e*, and one of the second belt tensioning rollers 502*a* to 502*e* is rotated by a belt drive motor 511. In this embodiment, the second belt tensioning roller 502*e*, which is rotated by the belt drive motor 511, corresponds to a drive roller that drives the second belt 502. The second belt tensioning roller 502*e* is, for example, an aluminum roller with a diameter of 24.8 mm, and silicone rubber with a thickness of 100 μm is formed on the peripheral surface, so that the coefficient of friction with the second belt 502 is set to "1.1".

The second belt tensioning roller 502*a* corresponds to a steering roller described below, and is, for example, an aluminum roller with a diameter of 25 mm, and the coefficient of friction with the second belt 502 is set to "0.5", which is smaller than that of the second belt tensioning roller 502*e* (drive roller). The second belt tensioning rollers 502*b* through 502*d* correspond to idler rollers that tension the second belt 502, and are aluminum rollers with a diameter of 25 mm, for example, and the coefficient of friction with the second belt 502 is set to "0.1". When the second belt tensioning roller 502*e* is rotated by the belt drive motor 511, the second belt 502 rotates in a direction of an arrow C in the figure.

In this embodiment, a drive chain 504*a* is provided at the shaft end portion of the second belt tensioning roller 502*e*. This drive chain 504*a* forms a part of the drive gear chain for transmitting the rotational driving force of the belt drive motor 511 to rotate the first belt 501.

On the other hand, the first belt 501 is hung around the plurality of first belt tensioning rollers 501*a* to 501*e* so that it can contact the second belt 502. At least one of the first belt tensioning rollers 501*a* to 501*e* is rotated by the driving power of the belt drive motor 511 through a drive gear chain comprising drive chains 504*a* to 504*d*. In the case of this embodiment, the first belt tensioning roller 501*e* rotated by the drive chain 504*d* corresponds to a drive roller that drives the first belt 501. The first belt tensioning roller 501*e* is, for example, an aluminum roller having a diameter of 24.8 mm, and silicone rubber having a thickness of 100 μm is formed on the outer surface, so that the coefficient of friction with the first belt 501 is set to "1.1". This causes the first belt 501 to rotate in a direction of arrow B in the figure. In other words, the first belt 501 and the second belt 502 are rotated in the same direction at a cooling nip portion T4 by the belt drive motor 511, which is the same drive source.

The first belt tensioning roller 501*a* corresponds to a steering roller described below. The first belt tensioning roller 501*a* is, for example, an aluminum roller with a diameter of 25 mm, and an acrylic layer with a thickness of 100 μm is formed on its outer peripheral surface, so that the coefficient of friction with the first belt 501 is set to "0.5", which is smaller than that of the first belt tensioning roller 501*e* (drive roller). The first belt tensioning rollers 501*b*-501*d* correspond to idler rollers that tension the first belt 501, for example, they are aluminum rollers with a diameter of 25 mm, and the coefficient of friction with the first belt 501 is set to "0.1". The first belt tensioning roller 501*e* and the second belt tensioning roller 502*e* do not form a nip with each other. When the friction coefficient of the drive rollers (501*e*, 502*e*) is greater than that of the steering rollers (501*a*, 502*a*) as described above, the belt shifting is more pronounced when the drive roller is tilted relative to the other rollers.

<One-Way Clutch>

Each of the drive chains 504*a* through 504*d* that transmit the rotational driving force of the belt drive motor 511 is a gear. And any of the drive chains 504*a* to 504*d* has a one-way clutch 505 that shuts off the transmission of the drive force depending on the direction of the drive force. In the case of this embodiment, the one-way clutch 505 is press-fitted into the inner circumference of the drive chain 504*d* and is arranged so that the center of rotation of the drive chain 504*d* and the center of rotation of the one-way clutch 505 are the same. In other words, the drive chain 504*d* is installed on the rotational axis of the first belt tensioning roller 501*e* via the one-way clutch 505.

The one-way clutch 505 does not transmit the driving force by the drive chain 504*d* to the rotational shaft of the first belt tensioning roller 501*e* when the first belt tensioning roller 501*e* and the drive chain 504*d* are moving in opposite directions relative to each other. That is, when the moving speed of the first belt 501 becomes faster than that of the second belt 502, the one-way clutch 505 causes the drive chain 504*d* and the rotating axis of the first belt tensioning roller 501*e* to enter a drive cutoff state. In this case, the first belt tensioning roller 501*e* rotates freely (idle) with respect to the drive chain 504*d*. In other words, regardless of the drive transmission by the drive chains 504*a* to 504*d*, the first belt tensioning roller 501*e* and thus the first belt 501 rotates.

When a one-way clutch 505 is provided, if the moving speed of the first belt 501 becomes faster than that of the second belt 502, the drive chain 504*d* receives the driving force of the belt drive motor 511 and rotates, and the first belt tensioning roller 501*e* receives the rotation of the first belt 501 and rotates. In this case, the first belt 501 is only accompanied by the second belt 502 which is in contact with it at the cooling nip portion T4, and no driving force is added by the belt drive motor 511. Therefore, the moving speed of the first belt 501 follows the moving speed of the second belt 502 and gradually decreases so that it becomes equal to the speed of the second belt 502.

As the moving speed of the first belt 501 decreases as described above, the circumferential speed of the first belt tensioning roller 501*e* decreases to less than the circumferential speed of the drive chain 504*d* which is driven by the belt drive motor 511 through the drive chains 504*a* to 504*c*. Then, the drive chain 504*d* and the rotational axis of the first belt tensioning roller 501*e* become drive transmission state again by the one-way clutch 505. When the drive train 504*d* and the rotational axis of the first belt tensioning roller 501*e* become the drive transmission state by the one-way clutch 505, the drive power of the belt drive motor 511 is transmitted to the first belt tensioning roller 501*e*, and the first belt tensioning roller 501*e* is rotated according to the power. At this time, the moving speed of the first belt 501 is the same as the moving speed of the second belt 502. When the moving speed of the first belt 501 becomes faster than the moving speed of the second belt 502 again, the drive is shut off by the one-way clutch 505 as described above.

In this way, the one-way clutch 505 is provided to change the transmission and interruption of the drive in the drive chain 504*d* and the rotational axis of the first belt tensioning roller 501*e*. Then, when there is a speed difference between the moving speed of the first belt 501 and that of the second belt 502, the one-way clutch 505 repeats whether or not the driving force is transmitted between the drive chain 504*d* and the rotating shaft of the first belt tensioning roller 501*e*. This prevents a speed difference from occurring between the first belt 501 and the second belt 502.

<Heat Sink>

The recording material S, on which the toner image has been fixed, is held between the first belt 501 and the second belt 502, and is conveyed in a conveyance direction (arrow D direction) by the rotation of these belts. At that time, the recording material S passes through the cooling nip portion T4 formed by the first belt 501 and the second belt 502. In this embodiment, the first belt 501 is cooled by heat sink 503. The heat sink 503 is disposed so as to contact the inner surface of the first belt 501 at the point where the cooling nip portion T4 is formed in order to efficiently cool the recording material S. The recording material S is cooled through the first belt 501 as it passes through the cooling nip portion T4. For example, if the temperature of the recording material S is about 90° C. before passing through the recording material cooling device 50, the recording material S is cooled so that it becomes about 60° C. after passing through the recording material cooling device 50. As the recording material S is cooled, the toner on the recording material S is cooled and adheres to it.

The heat sink 503 as a cooling member is a heat sink made of metal, such as aluminum. The heat sink 503 has a heat-receiving portion 503*a* for contacting the first belt 501 to take heat from the first belt 501, a heat-dissipating portion 503*b* for dissipating the heat, and a fin base 503*c* for conducting the heat from the heat-receiving portion 503*a* to the heat-dissipating portion 503*b*. The heat-dissipating portion 503*b* is formed by a large number of heat-dissipating fins in order to promote efficient heat dissipation by increasing the contact area with the air. For example, the heat-dissipating fins are set to have a thickness of 1 mm, a height of 100 mm, and a pitch of 5 mm, and the fin base 503*c* is set to have a thickness of 10 mm. In order to forcibly cool the heat sink 503 itself, one or more cooling fans 513 are provided to blow air toward the heat sink 503 (in detail, the heat-dissipating portion 503*b*). The air volume of the cooling fans 513 is set to 2 m3/min, for example. The cooling of the heat sink 503 is not limited to the cooling fans 513.

On the other hand, pressure rollers 509*a* and 509*b* are provided on the inner circumference side of the second belt 502 to pressurise the second belt 502 toward the heat sink 503 of the second unit 502U. The pressure rollers 509*a* and 509*b* as pressure members pressurise the second belt 502 with a pressurising pressure of, for example, 9.8 N (1 kgf). This ensures that the first belt 501 through the second belt 502 is in contact with the heat sink 503 (heat-receiving portion 503*a* to be described in detail later).

<Steering Control>

In such a recording material cooling device 50, when an endless belt such as the first belt 501 and the second belt 502 is supported and rotated by a plurality of rollers, a meandering phenomenon in which the rotating belt moves in the width direction may occur. Therefore, one of the multiple rollers supporting the first belt 501 and the second belt 502 is tilted as a steering roller, and the first belt 501 and the second belt 502 are reciprocated in the width direction to suppress the meandering phenomenon.

In this embodiment, the first belt tensioning roller 501*a* and the second belt tensioning roller 502*a* are steering rollers provided to control the shifting of the first belt 501 and the second belt 502, respectively. These steering rollers (501*a*, 502*a*) press the first belt 501 and the second belt 502 from the inner circumference to the outer circumference so that the tension of the first belt 501 and the second belt 502 is, for example, about 39.2 N (about 4 kgf). To do so, the first belt tensioning roller 501*a* is driven by a spring 507*a* and the second belt tensioning roller 502*a* is urged by a spring 508*a*. The steering rollers (501*a*, 502*a*) are separately steered by a steering mechanism 400 to control the meandering of the first belt 501 and the second belt 502 (steering control) by cutting the steering angle with the center portion of its rotational axis direction (width direction) as the turning fulcrum.

At one point in the rotation path of the first belt 501 and the second belt 502, respectively, the sensor portion 390 is provided to detect the end position of the first belt 501 and the second belt 502, respectively. Based on the detection signal of the sensor portion 390, the end positions of the first belt 501 and the second belt 502 during rotation are detected. Then, the steering angle of the steering rollers (501*a*, 502*a*) is adjusted by operating the steering mechanism 400 described above based on the detected end positions.

<About Belt Connection and Disconnection>

Figure 3:
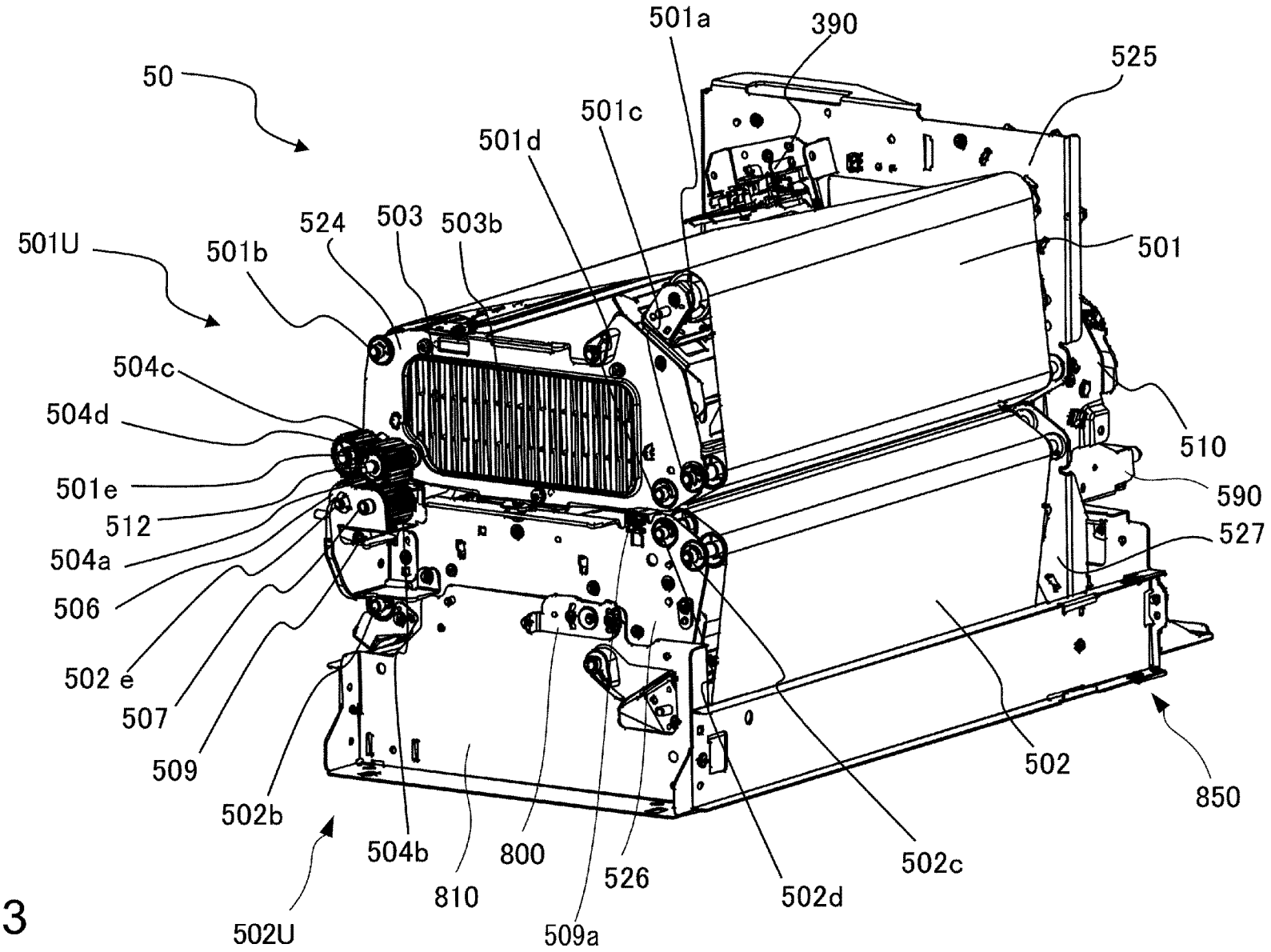
FIG. 3 is a perspective view showing the recording material cooling device when a first unit is in a contact position.

The first unit 501U is movable to the contact position where the first belt 501 and the second belt 502 are in contact with each other to form the cooling nip portion T4, and to the separation position where the first belt 501 and the second belt 502 are separated from each other to not form the cooling nip portion T4. FIG. 3 shows the case where the first unit 501U is in the contact position, and FIG. 4 shows the case where the first unit 501U is in the separation position.

In this embodiment, the first unit 501U is provided so that it can be rotated up and down with respect to the second unit 502U with the rotational axis (not shown) of a rotation mechanism 510 as a rotation means as a rotation center. This means that when a so-called jam occurs in the recording material cooling device 50 where the recording material S stays in the device, the operator can separate the first belt 501 from the second belt 502 to remove the recording material S jammed in the cooling nip portion T4. The purpose is also to allow the operator to loosen the first belt 501 and the second belt 502 in order to replace the first belt 501 and the second belt 502, as described later.

Figure 4:
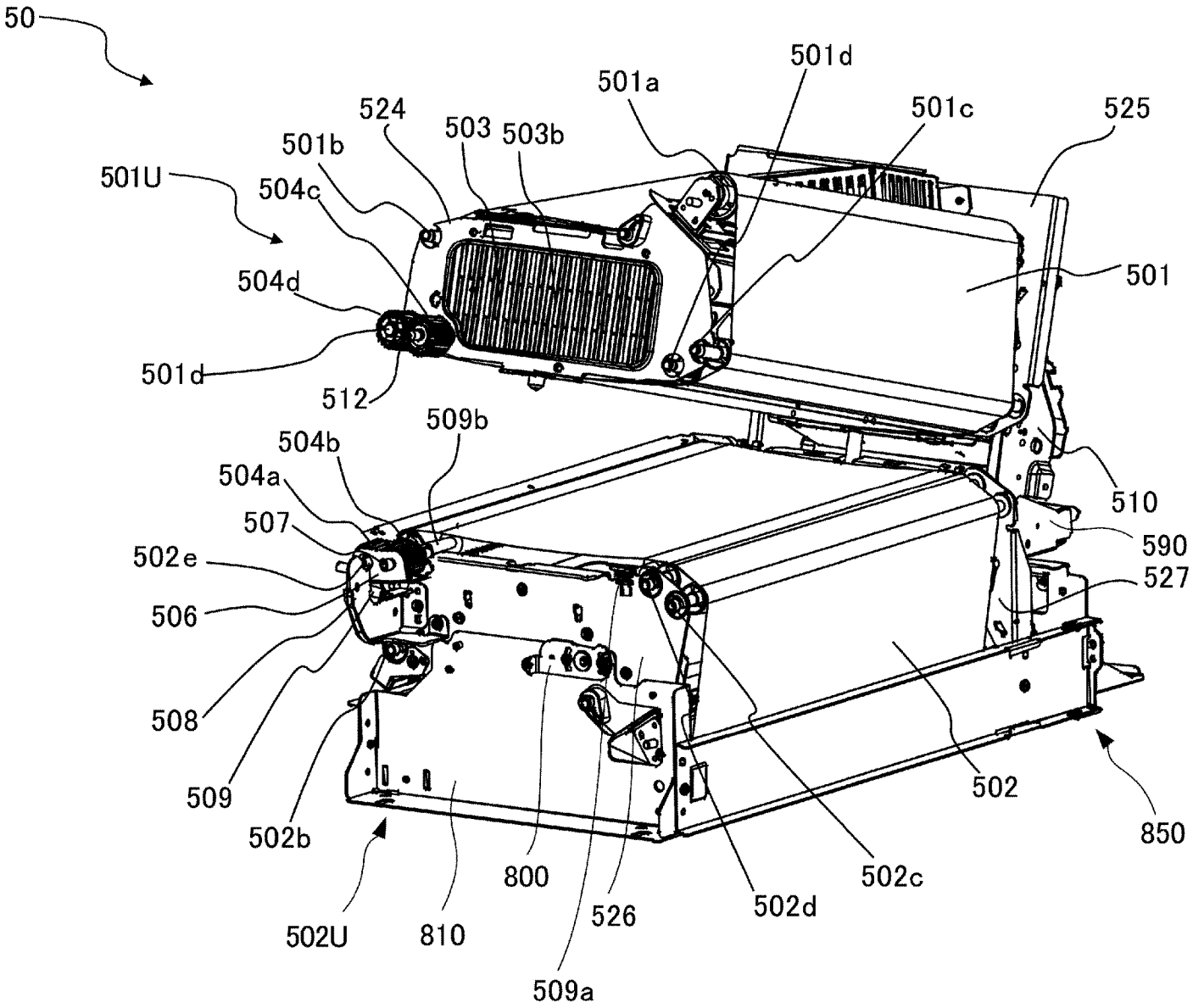
FIG. 4 is a perspective view showing the recording material cooling device when the first unit is in a separation position.

As shown in FIG. 3 and FIG. 4, a first front support plate 524 is disposed on one end side of the first belt tensioning rollers 501*a* to 501*e*. The first front support plate 524 rotatably supports one end side of the first belt tensioning rollers 501*a*-501*e*, and also supports one end side of the heat sink 503. A first rear support plate 525 rotatably supports the other end side of the first belt tensioning rollers 501*a*-501*e*, and also supports the other end side of the heat sink 503. The first front support plate 524 as a third supporting member and the first rear supporting plate 525 as a fourth supporting member are each a single member formed of sheet metal.

On the other hand, a second front support plate 526 is disposed on one end side of the second belt tensioning rollers 502*a* to 502*e*, and the second front support plate 526 rotatably supports one end side of the second belt tensioning rollers 502*a* to 502*e* and the pressure rollers 509*a* and 509*b* (see FIG. 2). A second rear support plate 527 rotatably supports the other end sides of the second belt tensioning rollers 502*a*-502*e* and the pressure rollers 509*a*, 509*b*. The second front support plate 526 as a first supporting member and the second rear support plate 527 as a second supporting member are each a single member formed of sheet metal.

<Pressure Release Lever>

In the recording material cooling device 50 of this embodiment, the steering roller (501*a*) can be moved between the tensioned position where the first belt 501 is tensioned and the non-tensioned position where the first belt 501 is loosened in order to facilitate replacement of the first belt 501 by the operator. When the steering roller (501*a*) is in the non-tensioned position, the contact pressure on the first belt 501 is smaller than when the steering roller (501*a*) is in the tensioned position, and the tensioning of the first belt 501 is loosened. Similarly, in order for the operator to replace the second belt 502, the steering roller (502*a*) can be moved by manual operation between the tensioned position where the second belt 502 is tensioned and the non-tensioned position where the second belt 502 is loosened.

Figure 5:
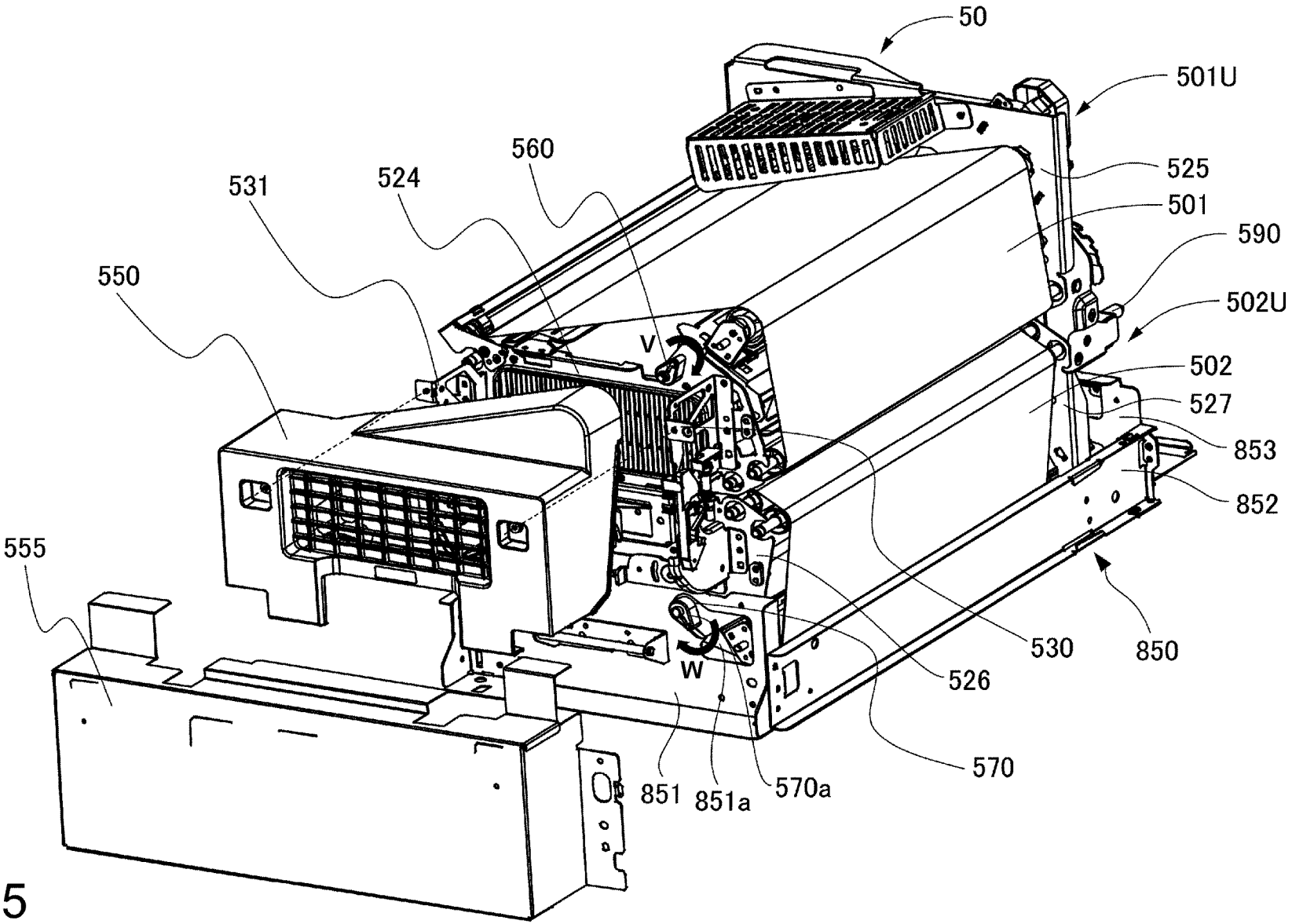
FIG. 5 is an exploded perspective view illustrating a pressure release lever.

As shown in FIG. 5, in each of the first unit 501U and the second unit 502U, a pressure release lever (560, 570) is freely rotatable on one end side of the steering rollers (501*a*, 502*a*). As the operator grasps and rotates the pressure release levers (560, 570), the steering rollers (501*a*, 502*a*) move between a tensioned position and a non-tensioned position. For example, when the pressure release lever 560 of the first unit 501U is rotated in a direction of an arrow V by the operator, the first belt 501 becomes taut, and when the pressure release lever 560 is rotated in the direction opposite to the arrow V, the first belt 501 becomes loose and not taut. On the other hand, when the pressure release lever 570 of the second unit 502U is rotated by the operator in the direction of the arrow W, the second belt 502 becomes taut, and when the pressure release lever 570 is rotated in the opposite direction of the arrow W, the second belt 502 becomes unstretched and loose.

In this embodiment, the front surface of the first unit 501U is covered by a front cover 550 which is attached by screws or the like to each of cover mounting portions 530 and 531 provided on the first front support plate 524. The front cover 550 can be detachably attached to the cover mounting portions 530 and 531 so as to cover the pressure release lever 560 of the first unit 501U. Therefore, in the case of the first unit 501U, the operator needs to remove the front cover 550 in order to access and operate the pressure release lever 560.

On the other hand, the front surface of the second unit 502U is covered by a sheet metal cover 555 that is attached to a main assembly frame (not shown). The sheet metal cover 555 is arranged to cover the pressure release lever 570 of the second unit 502U, and is detachably attached to the main assembly frame. Therefore, it is necessary to remove the sheet metal cover 555 in order for an operator to access the pressure release lever 570. However, in the second unit 502U, in order to restrain the rotation of the pressure release lever 570, a gripping portion 570*a* of the pressure release lever 570, which is grasped by the operator, is fitted into a fitting hole 851*a* formed in a front retaining plate 851 of a unit retaining portion 850 described below. This fitting hole 851*a* is formed in a shape that follows the outline of the gripping portion 570*a*. That is, when the gripping portion 570*a* is fitted into the fitting hole 851*a*, the pressure release lever 570 is not rotated in either the direction of the arrow W or the opposite direction of the arrow W. Therefore, in the case of the second unit 502U, the operator needs to remove not only the sheet metal cover 555 but also the front retaining plate 851 in order to access and operate the pressure release lever 570.

Thus, in this embodiment, in the first unit 501U, the pressure release lever 560 can be operated only by the operator removing the front cover 550. On the other hand, in the second unit 502U, the pressure release lever 570 cannot be operated unless the operator removes the sheet metal cover 555 and the front retaining plate 851. This is because the pressure release lever 560 of the first unit 501U is used more frequently than the pressure release lever 570 of the second unit 502U. That is, since the first belt 501 rubs against the heat sink 503, it wears more easily than the second belt 502, which does not rub against the heat sink 503. Therefore, the replacement frequency of the first belt 501 is higher than that of the second belt 502. From the viewpoint of improving the replaceability of the first belt 501, which is frequently replaced by the operator, the pressure release lever 560 is made easier to operate in the first unit 501U as described above.

<Static Charge Eliminator Needle>

In the case of the belt-cooled recording material cooling device 50, the first belt 501 is easily charged by the heat sink 503 rubbing against it during rotation, and the second belt 502 is easily charged by rotating in contact with the first belt 501. When the first belt 501 or the second belt 502 is electrically charged, the recording material S may stick to the first belt 501 or the second belt 502, or the recording material S may curl, causing the recording material S to be jammed in the equipment. In addition, when the first belt 501 or the second belt 502 is electrically charged, the recording material S that passes through the cooling nip portion T4 (see FIG. 2) may be also electrically charged. If the recording material S is electrically charged, it may be difficult to discharge the recording material S to the discharge tray 120 (see FIG. 1) in a correct posture, and the recording material S may not be properly stacked on the discharge tray 120.

Figure 6:
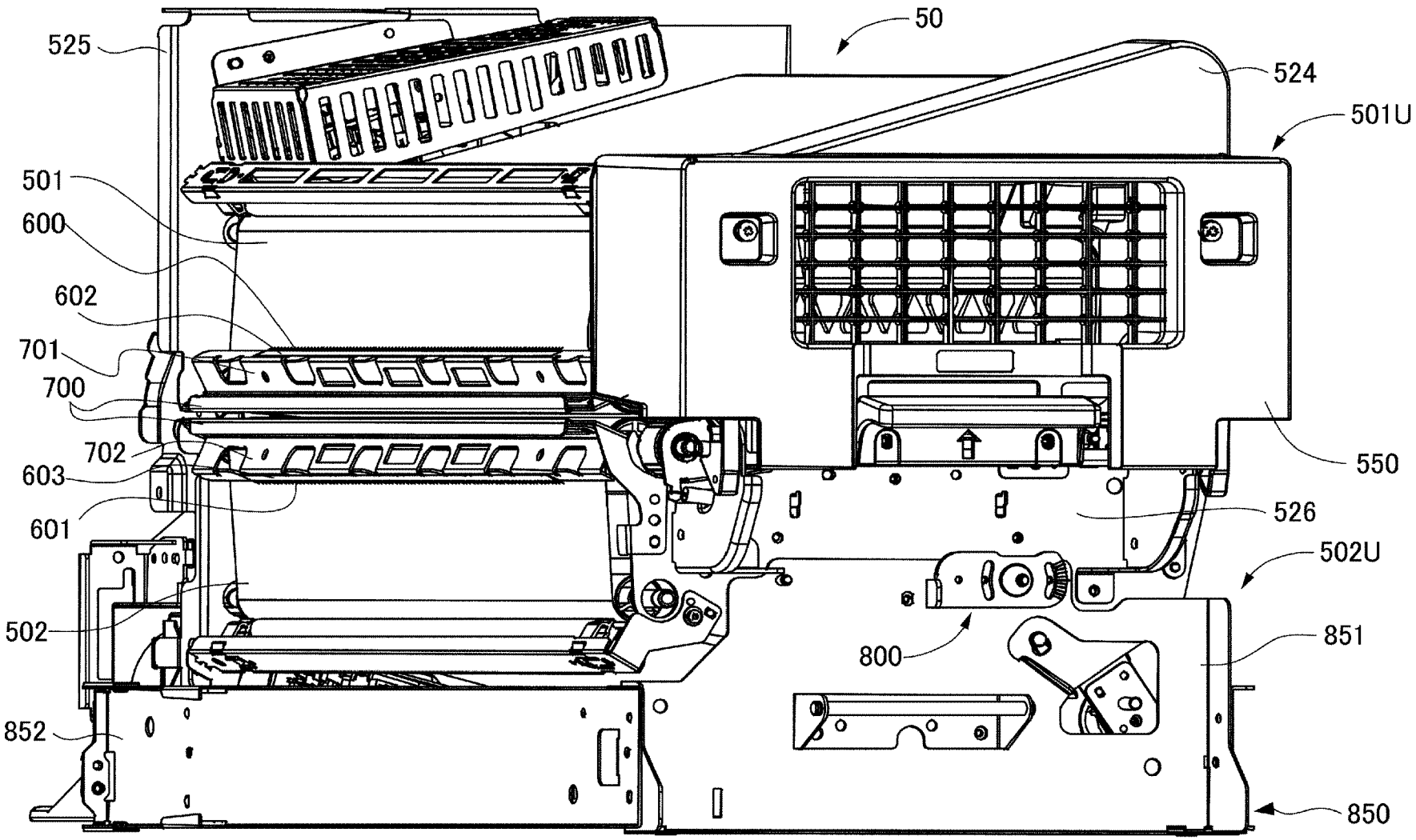
FIG. 6 is an enlarged view illustrating a static eliminating needle.

Therefore, as shown in FIG. 6, in the first unit 501U and the second unit 502U, static eliminating needles 600 and 601 are provided at the downstream side of the recording material S conveyance direction from the cooling nip portion T4 (see FIG. 2), respectively. Specifically, in the first unit 501U, the static eliminating needle 600 is attached to a connecting sheet metal 701 connecting the first front support plate 524 and the first rear support plate 525 by means of an attaching member 602 (e.g., a sticker). The static eliminating needle 600 suppresses the electrification of the first belt 501 by contacting the outer peripheral surface of the rotating first belt 501 with its tip portion.

Similarly, in the second unit 502U, the static eliminating needle 601 is attached to a connecting sheet metal 702 connecting the second front support plate 526 and the second rear support plate 527 by means of an attachment member 603 (e.g., a sticker). The static eliminating needle 601 suppresses the electrification of the second belt 502 by contacting the outer peripheral surface of the rotating second belt 502 with the tip portion. The connecting sheet metal 701 and the connecting sheet metal 702 are each provided with a pair of discharge guides 700 for discharging the recording material S that has passed through the cooling nip portion T4 while suppressing it from both sides.

Figure 7:
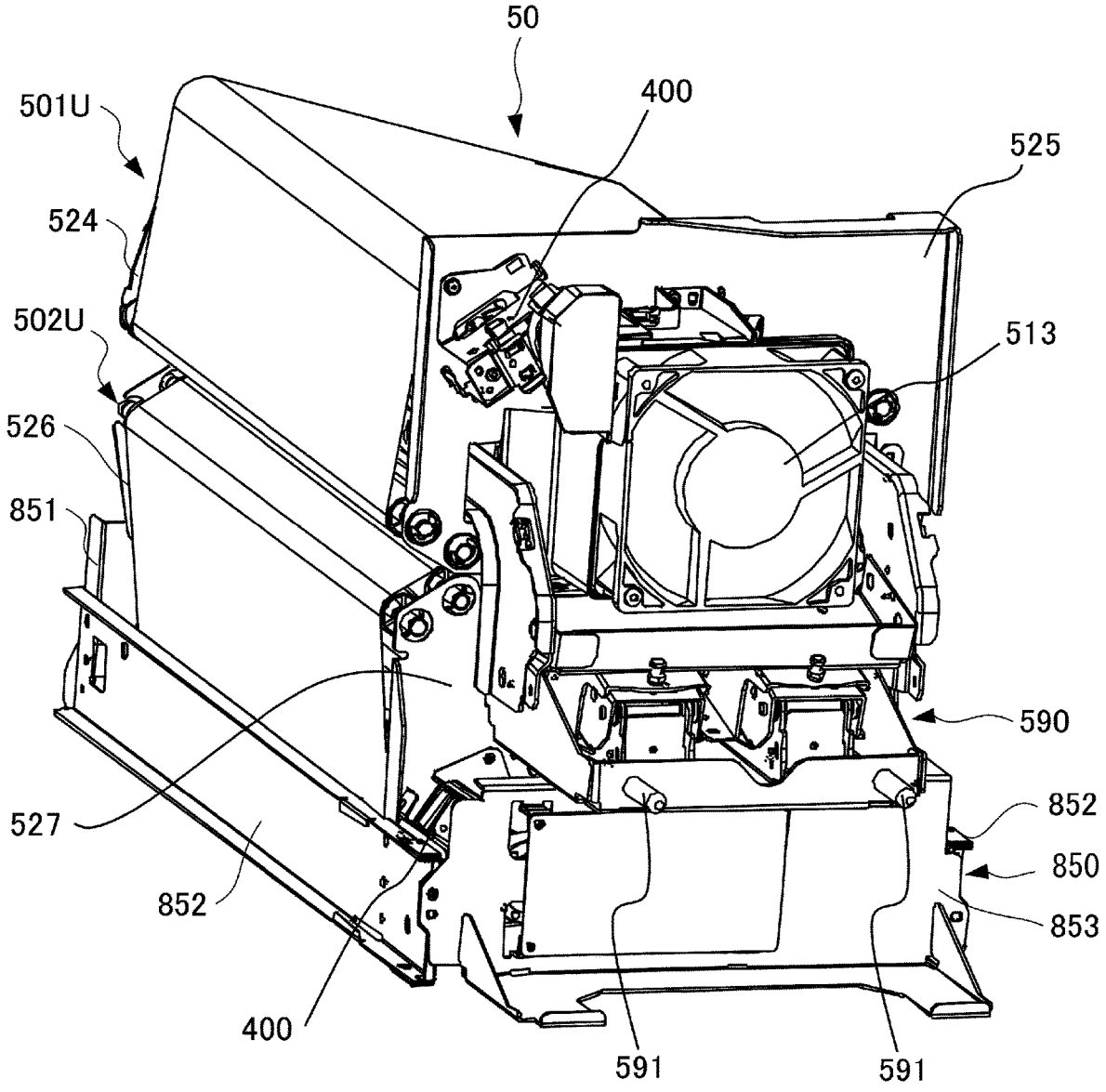
FIG. 7 is an exploded perspective view showing the recording material cooling device as seen from a rear support plate side.

As shown in FIG. 7, in this embodiment, the steering mechanism 400 and the cooling fan 513 (one here) described above are attached to the first rear support plate 525 of the first unit 501U. On the other hand, the steering mechanism 400 is also mounted on the second rear support plate 527 of the second unit 502U. In addition, the rotation mechanism 510 is attached across the first rear support plate 525 of the first unit 501U and the second rear support plate 527 of the second unit 502U. Therefore, the steering mechanism 400 and the cooling fan 513 rotate together with the first unit 501U as the first unit 501U is rotated by the rotation mechanism 510.

The second rear support plate 527 has a positioning portion 590 for positioning the recording material cooling device 50 when it is mounted on a main assembly 100A (see FIG. 1) as the support frame of the image forming apparatus 100. The positioning portion 590 has a plurality of fitting portions 591 that are spaced apart in the recording material conveyance direction D and extended in the width direction. These fitting portions 591 are formed in the shape of cylindrical shafts, for example, and are fitted to fitted portions provided in the main assembly 100A. In this way, the recording material cooling device 50 is attached to the main assembly 100A with the second rear support plate 527 side of the second unit 502U as a reference.

The recording material cooling device 50 has the unit retaining portion 850. The unit retaining portion 850 forms a holding frame to hold the second unit 502U by means of the front retaining plate 851 that holds the second front support plate 526, a rear holding plate 853 that holds the second rear support plate 527, and two connecting plates 852 that connect the front holding plate 851 and the rear holding plate 853.

The front retaining plate 851 and the connecting plate 852 each have a plurality of mounting holes through which mounting screws can be inserted. In this embodiment, the recording material cooling device 50 is fixed to the main assembly 100A by screwing the front retaining plate 851 and the two connecting plates 852 to the main assembly frame with mounting screws while the plurality of fitting portions 591 are fitted to the fitted portions respectively. In this way, the recording material cooling device 50 is fixed to the main assembly 100A. As described in detail below, the second front support plate 526 is movable relative to the front retaining plate 851 (see FIG. 8 and part (c) of FIG. 9 below). The front retaining plate 851 is detachable from the connecting plate 852. This is because, as described above, in the present embodiment, the rotation of the pressure release lever 570 is restrained by the front retaining plate 851, and the operator needs to remove the front retaining plate 851 in order to operate the pressure release lever 570.

By the way, in the conventional belt-cooling method recording material cooling device, the belt may shift off and damage the belt and the front and rear support plates that support the rollers that stretch the belt in spite of the steering control. This was particularly noticeable in the second unit 502U, which does not have a heat sink 503. This is due to the following reasons.

In the first unit 501U having the heat sink 503, the first front support plate 524 and the first rear support plate 525 are formed from highly rigid sheet metal to support the heavy heat sink 503. On the other hand, in the second unit 502U, the second front support plate 526 is formed from low-rigidity sheet metal because it is not necessary to support the heat sink 503. As for the second rear support plate 527, it is formed using high-rigidity sheet metal in order to attach the rotation mechanism 510. Therefore, in the past, the second front support plate 526 has been deformed and tilted relative to the second rear support plate 527 due to component tolerances of the recording material cooling device 50 and parts affecting the installation in the main assembly 100A.

For example, the fitting portion 591 of the positioning portion 590 in the recording material cooling device 50, the mounting holes of the unit retaining portion 850, the fitted portions provided in the main assembly 100A that are fitted into the fitting portion 591, holes into which screws are screwed, and other parts tolerances cause the second front support plate 526 to deform. In such a case, each roller that stretches the second belt 502 is inclined more than expected, and it becomes difficult to control the shifting of the second belt 502 even when steering control is performed to tilt the steering roller (502*a*) in the second unit 502U.

As shown in FIG. 2, suppose that the recording material cooling device 50 is fixed to the main assembly 100A with the second front support plate 526 tilted in the direction of arrow G against the second rear support plate 527 (see FIG. 3). Then, the steering roller (502*a*) tilts outward of the second belt 502 so that one end portion supported by the second front support plate 526 of the steering roller (502*a*) is located lower than the other end portion supported by the second rear support plate 527 of the steering roller (502*a*). Hence, the second belt 502 stretched on the steering roller (502*a*) is more likely to move toward the second rear support plate 527.

Conversely, suppose that the recording material cooling device 50 is fixed to the main assembly 100A with the second front support plate 526 tilted in the direction of arrow H against the second rear support plate 527 (see FIG. 3). Then, the steering roller (502*a*) is tilted inwardly of the second belt 502 so that one end portion supported by the second front support plate 526 of the steering roller (502*a*) is located above the other end portion supported by the second rear support plate 527 of the steering roller (502*a*). Hence, the second belt 502 stretched on the steering roller (502*a*) is more likely to move toward the second front support plate 526.

The greater the inclination of the second front support plate 526 toward the second rear support plate 527 in the direction of the arrow G, the faster the movement speed of the second belt 502 toward the second front support plate 526 in accordance with the steering control than the movement speed toward the second rear support plate 527. On the contrary, the greater the inclination of the second front support plate 526 toward the second rear support plate 527 in the direction of the arrow H, the slower the movement speed of the second belt 502 toward the second front support plate 526 becomes in accordance with the steering control than the movement speed toward the second rear support plate 527. Thus, as the inclination of the second front support plate 526 with respect to the second rear support plate 527 increases, the difference between the movement speed of the second belt 502 when it moves toward the second front support plate 526 and the movement speed of the second belt 502 when it moves toward the second rear support plate 527 becomes faster. If the moving speed of the second belt 502 becomes too fast, even if steering control is applied to reverse the moving direction of the second belt 502 in the width direction, the second belt 502 may cause transient slippage and lean away without reversing.

<Adjustment Operating Mechanism>

In view of the above, this embodiment allows the operator to adjust the relative inclination of the rollers supported by the second front support plate 526 (and the second rear support plate 527) when mounting the recording material cooling device 50 on the main assembly 100A. The operator can adjust the relative inclination of the rollers supported by the second front support plate 526 (and the second rear support plate 527) after fixing the unit retaining portion 850 (in detail, the front retaining plate 851, the connecting plate 852, and the rear holding plate 853) to the main assembly 100A. To be able to do so, the recording material cooling device 50 is provided with an adjustment operating mechanism 800. When the adjustment operating mechanism 800 is operated by the operator, the second front support plate 526 is rotated relative to the front retaining plate 851, and the relative inclination of the rollers supported by the second front support plate 526 is changed accordingly. This point will be explained below using FIGS. 8 to 9 (*a*).

Figure 8:
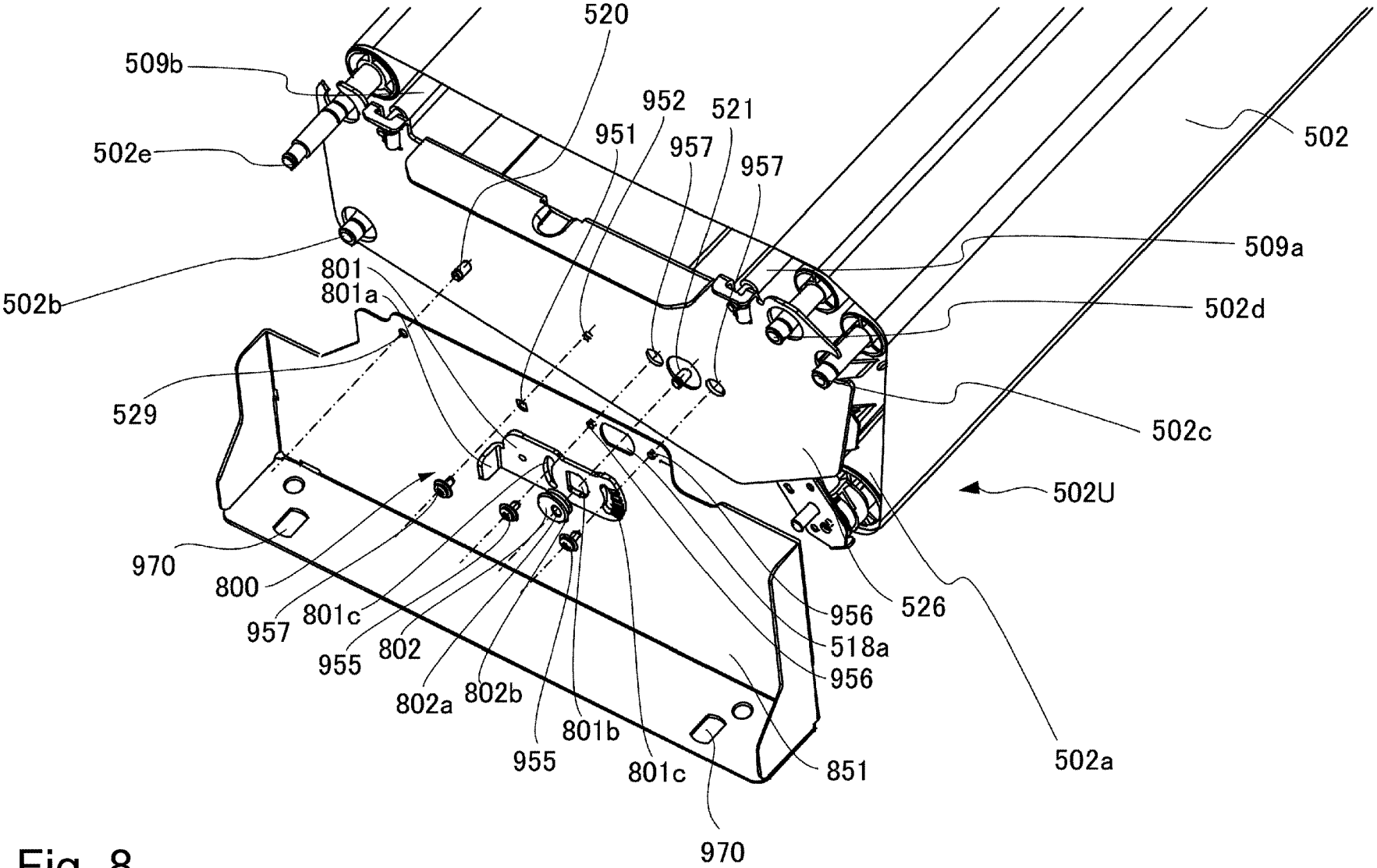
FIG. 8 is an exploded perspective view showing an adjustment operating mechanism.

As shown in FIG. 8, in the second unit 502U, the second front support plate 526 is attached to the front retaining plate 851 that is screwed to the main frame. The front retaining plate 851 as a holding member has a plurality of mounting holes 970 (two in this case) through which mounting screws (not shown) are inserted when screwing it to the main assembly frame. These mounting holes 970 are long holes in the width direction, so that the front retaining plate 851 can be fixed to the main assembly frame by correcting the misalignment in the width direction of the second front support plate 526 caused by component tolerance at the upstream and downstream sides of the recording material conveyance direction D.

The second front support plate 526 has an axially shaped first protruding shaft 520 and a second protruding shaft 521 that protrude toward the front retaining plate 851. The first protruding shaft 520 has its tip fitted into a fitting hole 529 formed in the front retaining plate 851 so that the second front support plate 526 can be rotated with respect to the front retaining plate 851 with the first protruding shaft 520 as the center of rotation. In the second front support plate 526, two support holes 957 are formed between the second protruding shaft 521 and one mounting portion 952 between the first protruding shaft 520 and the second protruding shaft 521. After adjusting the relative inclination of the rollers as described below, the operator can fix the second front support plate 526 to the front retaining plate 851 at any rotational position by attaching a fixing screw 950 as a fixing member to the mounting portion 952. The front retaining plate 851 has a through-hole 951 with a long hole for inserting the fixing screw 950 used for fixing the second front support plate 526.

On the front retaining plate 851, on the side opposite to the side facing the second front support plate 526, the adjustment operating mechanism 800 is rotatably provided on the front retaining plate 851. The adjustment operating mechanism 800 as an operating member has an adjustment plate 801 and an eccentric cam 802. The adjustment plate 801 as a pivoting portion is formed in an abbreviated L-shape and has a gripping portion 801*a* to be grasped by the user. The adjustment plate 801 has an abbreviated D-shaped fitting hole 801*b* to fit the eccentric cam 802, and two arc-shaped insertion holes 801*c* to insert screws 955 between the fitting holes 801*b*. The eccentric cam 802 is fitted in the fitting hole 801*b*, and rotates and displaces together with the adjustment plate 801 in accordance with the rotation of the adjustment plate 801. A cam surface 802*b* of the eccentric cam 802 is engaged with a hole portion 518*a* formed in the front retaining plate 851. The eccentric cam 802 also has a support hole 802*a* that supports the tip of the second protruding shaft 521 of the second front support plate 526. In other words, the second front support plate 526 and the eccentric cam 802 are connected by the second protruding shaft 521 as a connecting member so that they can operate together.

The moving range of the adjustment operating mechanism 800 is limited by two screws 955 inserted into each of the insertion holes 801*c* formed in the adjustment plate 801. The screws 955 are passed through the insertion holes 801*c* and through holes 956 formed in the front retaining plate 851, and are attached to the support holes 957 formed in the second front support plate 526.

According to the above-mentioned structure, the second front support plate 526 is not fixed to the front retaining plate 851 by the fixing screw 950, but is rotated to the front retaining plate 851 with the first protruding shaft 520 as the center of rotation by the operation of the adjustment plate 801 by the user. Parts (a) to (c) of FIG. 9 show specific examples.

Figure 9:
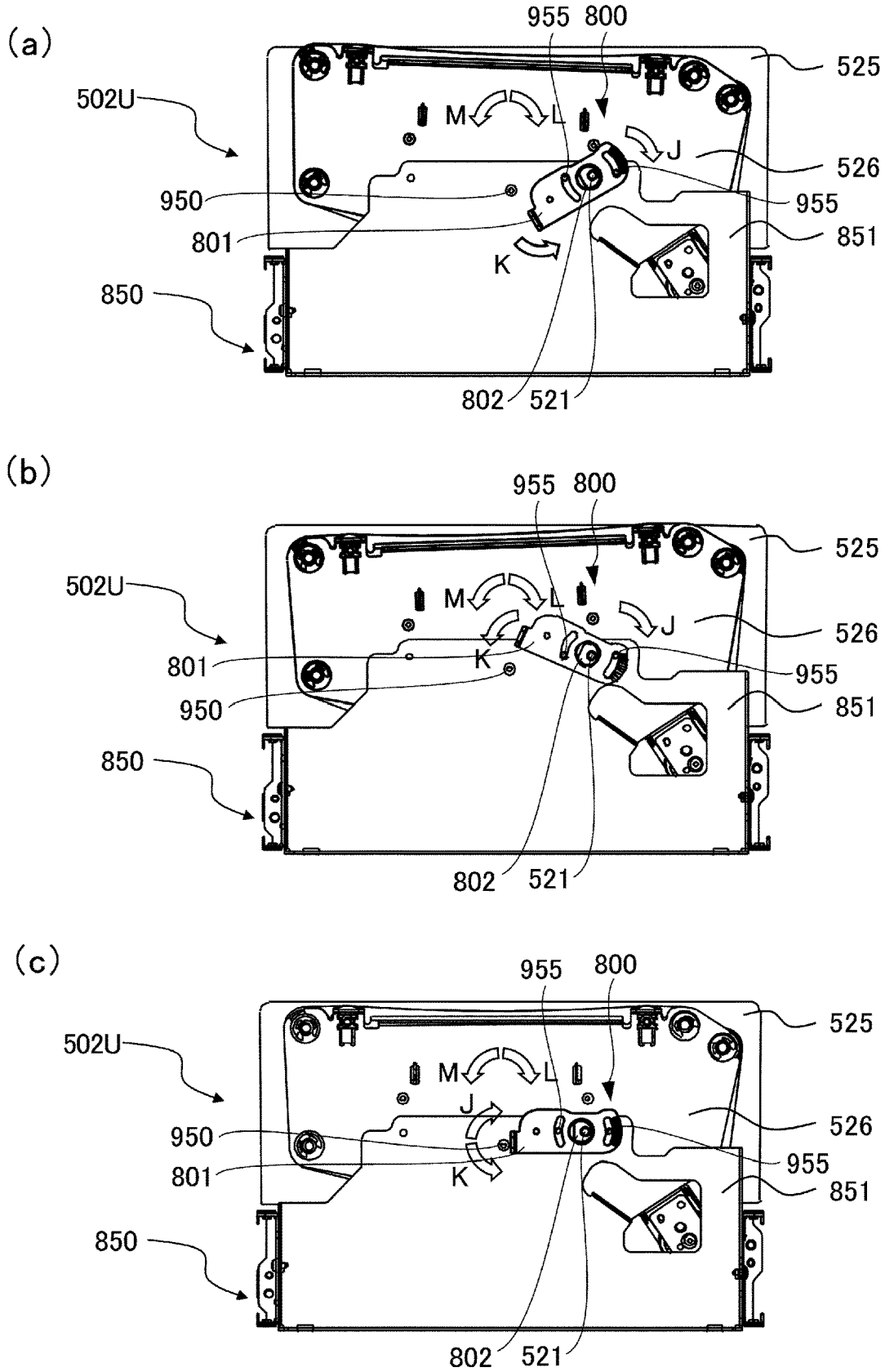
FIG. 9 is a view illustrating roller adjustment by the adjustment operating mechanism, part (a) showing when an adjustment plate is rotated and adjusted in a J direction, part (b) showing when the adjustment plate is rotated and adjusted in an M direction, and part (c) showing after adjustment.

As shown in part (a) of FIG. 9, suppose that the second front support plate 526, which supports the second belt tensioning rollers 502*a* to 502*e* (see FIG. 2), is deformed in a direction of an arrow L, and the unit retaining portion 850 is fixed to the main assembly 100A. In this case, at least one of the second belt tensioning rollers 502*a* to 502*e* can be tilted relatively due to the deformation of the second front support plate 526 caused by the parts tolerance of the second unit 502U and the main assembly 100A (see FIG. 1). The (initial) position of the adjustment operating mechanism 800 at this time varies according to the degree of deformation of the second front support plate 526, and more particularly according to the degree of inclination of the second front support plate 526 with respect to the second rear support plate 527.

In the state shown in part (a) of FIG. 9, the operator rotates the adjustment plate 801 of the adjustment operating mechanism 800 in a direction of arrow J before fixing the second front support plate 526 to the front retaining plate 851 using the fixing screw 950. When the adjustment plate 801 is rotated in the direction of arrow J by the operator, the eccentric cam 802 pushes up the second protruding shaft 521 of the second front support plate 526 in the direction of gravity. This causes the second front support plate 526 to be rotated in a direction of arrow M. Part (a) of FIG. 9 shows the state in which the rotation of the adjustment plate 801 in an arrow K direction is limited by the two screws 955.

Alternatively, as shown in part (b) of FIG. 9, suppose that the unit retaining portion 850 is fixed to the main assembly 100A with the second front support plate 526 deformed in the direction of arrow M. Even in this case, at least one of the second belt tensioning rollers 502*a* to 502*e* can be tilted relatively due to the deformation of the second front support plate 526 caused by the component tolerance of the second unit 502U and the main assembly 100A.

In the state shown in part (b) of FIG. 9, the operator rotates the adjustment plate 801 of the adjustment operating mechanism 800 in the direction of arrow K before fixing the second front support plate 526 to the front retaining plate 851 using the fixing screw 950. When the adjustment plate 801 is rotated in the direction of arrow K by the operator, the eccentric cam 802 pushes down the second protruding shaft 521 of the second front support plate 526 in the direction of gravity. This causes the second front support plate 526 to be rotated in the direction of the arrow L. In part (b) of FIG. 9, the state in which the rotation of the adjustment plate 801 in the arrow J direction is limited by the two screws 955 is shown.

As described above, when the operator rotates the adjustment plate 801 in the direction of arrow J or K, the second front support plate 526 is rotated in the direction of arrow M or L, and the deformation of the second front support plate 526 caused by the component tolerance of the second unit 502U or the main assembly 100A is corrected. When the deformation of the second front support plate 526 is corrected, even if the second belt tensioning rollers 502*a* to 502*e* supported by the second front support plate 526 are relatively tilted before the correction, the second belt tensioning rollers 502*a* to 502*e* are adjusted to an abbreviated parallel state as shown in part (c) of FIG. 9. The operator then fixes the second front support plate 526 to the front retaining plate 851 using the fixing screws 950. By fixing the second front support plate 526 to the front retaining plate 851 with the fixing screws 950, the second front support plate 526 is maintained in the corrected state in which deformation caused by component tolerance is suppressed. Thus, by adjusting the second belt tensioning rollers 502*a* to 502*e* to an abbreviated parallel state, belt shifting of the second belt 502 can be suppressed by steering control.

In the embodiment described above, the second unit 502U is provided with an adjustment operating mechanism 800 to allow the operator to compensate for the deformation of the second unit 502U and the main assembly 100A caused by the part tolerance of the second unit 502U and the main assembly 100A when installing the recording material cooling device 50 on the main assembly 100A. In contrast, the first unit 501U is not provided with the adjustment operating mechanism 800. This is because, as described above, the first unit 501U uses the highly rigid first front support plate 524 and first rear support plate 525 to support the heat sink 503, and the first belt tensioning rollers 501*a*-501*e* are supported by them. If the first front support plate 524 and the first rear support plate 525 are highly rigid, even if the first unit 501U is mounted on the main assembly 100A, the first front support plate 524 and the first rear support plate 525 are hardly deformed. Therefore, in the first belt tensioning rollers 501*a*-501*e* of the first unit 501U, the relative inclination of the rollers is less likely to occur to the extent that it becomes difficult to control the belt shifting by steering control compared to the second belt tensioning rollers 502*a*-502*e* of the second unit 502U. In the case of the first unit 501U having the heat sink 503, the steering control can sufficiently suppress the belt shifting of the first belt 501. Since this is the case, the first unit 501U is not provided with an adjustment operating mechanism 800.

As described above, in this embodiment, in the second unit 502U which does not have a heat sink 503, the front side plate is composed of two plates, the second front support plate 526 and the front retaining plate 851. The front retaining plate 851 is fixed to the main assembly 100A (main frame, etc.), and the second front support plate 526, which supports the second belt tensioning rollers 502*a* to 502*e*, is pivotable with respect to the front retaining plate 851. An adjustment operating mechanism 800 is provided in the second unit 502U so that the operator can manually rotate the second front support plate 526 while the front retaining plate 851 is fixed to the main assembly 100A. The operator can rotate the adjustment plate 801 of the adjustment operating mechanism 800 to move the second front support plate 526 relative to the front retaining plate 851. When the second front support plate 526 is moved relative to the front retaining plate 851, the deformation of the second front support plate 526 caused by the component tolerance of the second unit 502U and the main assembly 100A is corrected. As a result, the second belt tensioning rollers 502*a* to 502*e* supported by the second front support plate 526 are adjusted to an abbreviated parallel state. Thus, by adjusting the second belt tensioning rollers 502*a* to 502*e* to an abbreviated parallel state, the belt shifting of the second belt 502 can be suppressed by steering control.

Other Embodiments

In the above-mentioned embodiment, an example is shown in which a first protruding shaft 520 and a second protruding shaft 521 are provided in the second front support plate 526 and the fitting hole 529 and the hole portion 518*a* are formed in the front retaining plate 851 in order to rotate the second front support plate 526 against the front retaining plate 851 (see FIG. 8), but the present invention is not limited to this. For example, instead of the first protruding shaft 520, a rotating shaft protruding from the front retaining plate 851 to the second front support plate 526 may be provided, and a hole portion to support the rotating shaft rotatably may be formed in the second front support plate 526. Also, instead of the second protruding shaft 521, a cam protruding shaft projecting from the eccentric cam 802 to the second front support plate 526 may be provided, and a hole portion for fixing the cam protruding shaft may be formed in the second front support plate 526.

Figure 10:
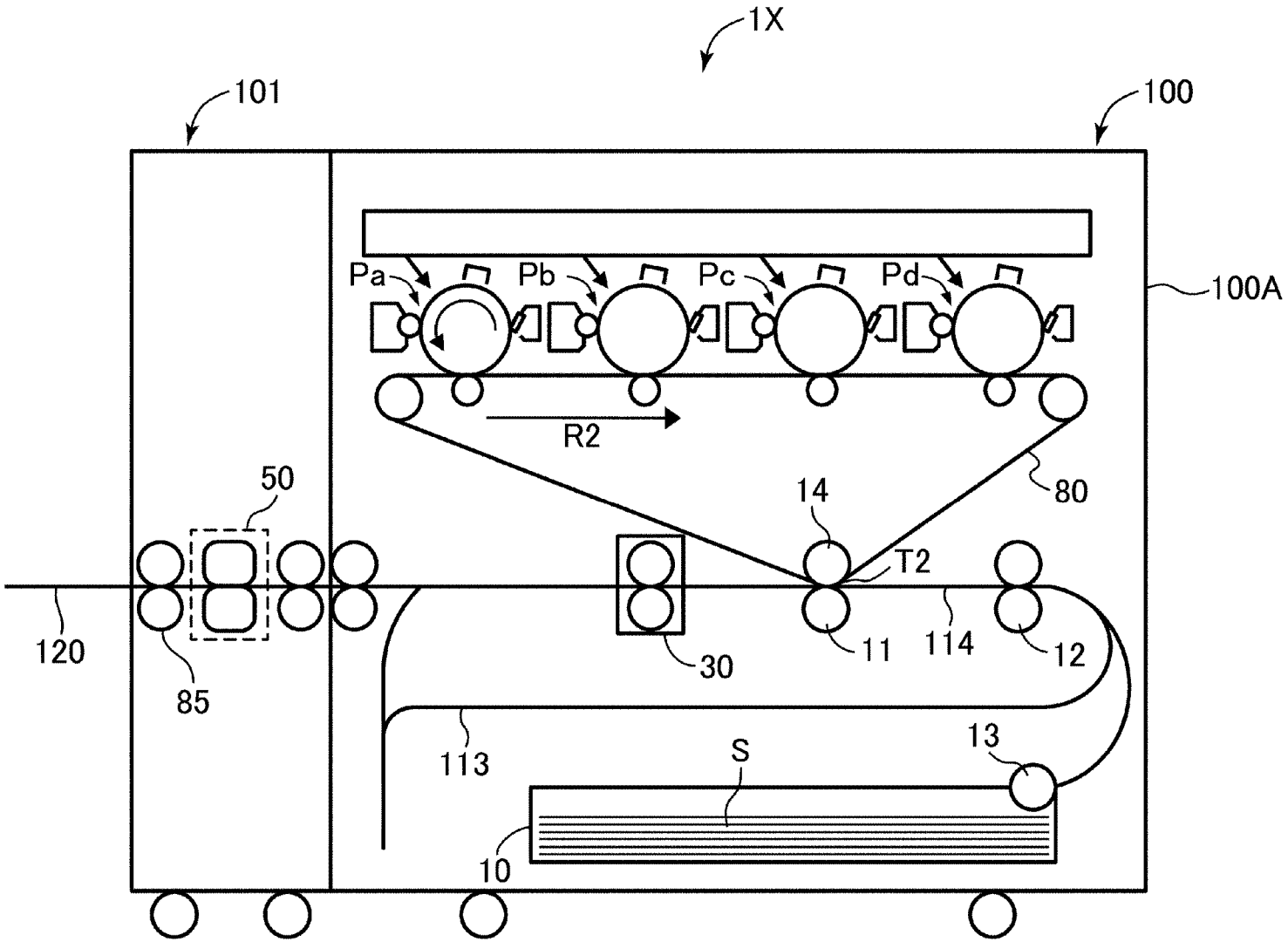
FIG. 10 is a schematic drawing showing an image forming system with a recording material cooling device outside the image forming apparatus.

In the above-mentioned embodiment, a case in which the recording material cooling device 50 is installed inside the image forming apparatus 100 is shown as an example (see FIG. 1), but the present invention is not limited to this case. For example, the recording material cooling device 50 may be installed outside of the image forming apparatus 100. FIG. 10 shows an image forming system 1X where the recording material cooling device 50 is installed outside the image forming apparatus 100.

The image forming system 1X shown in FIG. 10 has an image forming apparatus 100 and an external cooling unit 101 connected to the image forming apparatus 100. The external cooling unit 101 is configured to be connected to the image forming apparatus 100 as one of the peripheral devices that can be retrofitted to expand the functions of the image forming apparatus 100 (referred to as optional units, etc.). The external cooling unit 101 is arranged to cool the recording material S discharged from the image forming apparatus 100 to lower the temperature of the recording material S, which is higher than that before fixing, to a predetermined temperature or lower. The external cooling unit 101 has the recording material cooling device 50 described above for cooling the recording material S.

The recording material S that has been cooled by the external cooling unit 101 is discharged from the external cooling unit 101 by a discharge roller 85 and stacked onto the discharge tray 120. The discharge tray 120 is freely removable from the external cooling unit 101 and the image forming apparatus 100. In other words, the discharge tray 120 is attached to the image forming apparatus 100 when the external cooling unit 101 is not connected to the image forming apparatus 100 (see FIG. 1). When the external cooling unit 101 is connected to the image forming apparatus 100, it is removed from the image forming apparatus 100 by the operator and replaced with the external cooling unit 101. A plurality of external cooling units 101 may be connected as peripheral units. The operator can easily improve the cooling capacity of recording material S for the existing image forming apparatus 100 by increasing the number of connected external cooling units 101. The same effect as that of the first embodiment can be obtained by adopting the first embodiment described above when mounting the recording material cooling device 50 on the support frame of such an external cooling unit 101.

According to the present invention, it is possible to compensate for the relative tilt of the rollers that may occur when mounting the recording material cooling device with a simple configuration.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-100038 filed on Jun. 9, 2020, which is hereby incorporated by reference herein in its entirety.

What is claimed is:

1. An image forming apparatus comprising:

a fixing device comprising:

a rotatable heating member; and a rotatable pressing member configured to form a first nip portion by contacting said rotatable heating member, said rotatable pressing member fixing a toner image onto a recording material with said rotatable heating member; and the image forming apparatus further comprising:

a cooling device provided on a downstream side of said fixing device with respect to a feeding direction of the recording material and configured to cool the recording material, said cooling device comprising:

a belt;

a plurality of rollers stretching said belt;

a heat sink contacting an inner peripheral surface of said belt;

a feeding unit configured to form a second nip portion feeding the recording material with said belt; and an eliminating member configured to suppress electrification of said belt by contacting an outer peripheral surface of said belt;

the image forming apparatus further comprising:

a pair of side plates configured to support said plurality of rollers;

a connecting member formed of sheet metal and configured to connect said pair of side plates; and a guide member provided on the downstream side of said second nip portion with respect to the feeding direction of the recording material at said second nip portion and configured to guide the recording material discharged from said second nip portion, wherein said eliminating member is attached to said connecting member, and wherein said guide member is provided on said connecting member.

2. The image forming apparatus according to claim 1, wherein said eliminating member is provide on the downstream side of said second nip portion with respect to the feeding direction of the recording material at said second nip portion.

3. The image forming apparatus according to 1, wherein said eliminating member includes an eliminating needle.

4. The image forming apparatus according to claim 1, wherein said feeding unit includes a second belt forming said second nip portion with said belt, a second plurality of rollers stretching said second belt, a second eliminating member suppressing electrification of said second belt by contacting an outer peripheral surface of said second belt.

5. The image forming apparatus according to claim 1, further comprising:

a first unit which includes said belt, said plurality of rollers and said heat sink;

a second unit which includes said feeding unit; and a rotation mechanism configured to rotatably support said first unit to said second unit.

* * * * *